US005671924A

United States Patent [19]

Scott

[11] Patent Number: 5,671,924

[45] Date of Patent: Sep. 30, 1997

[54] PORTABLE TARGET STAND

[76] Inventor: Van Edward Scott, 2602 Riverview Ave., #11, North Muskegon, Mich. 49445

[21] Appl. No.: 373,557

[22] Filed: Jan. 17, 1995

[51] Int. Cl.[6] ..... F41J 3/00

[52] U.S. Cl. ..... 273/407; 273/102 B; 273/102 S; 273/395

[58] Field of Search ..... 273/407, 400, 273/406, 408, 409, 550, 395, 26 H, 411, 402; 248/463

[56] References Cited

U.S. PATENT DOCUMENTS 4,254,952 3/1981 Playter, Jr. ..... 273/26 A 4,629,188 12/1986 Mahieu ..... 273/407

5,251,885 10/1993 Logan ..... 273/182 R

*Primary Examiner*—Vincent Millin

*Assistant Examiner*—Charles W. Anderson

[57] ABSTRACT

A portable target stand having one or more targets mounted on a target backer which is adjustably supported by two vertical support posts partially inserted into the ground. The target backer has a left flap portion and a right flap portion which are folded and secured along the edges of the flap portions to the rear surface of the target backer to form two vertical sleeves into which the posts are inserted. The target backer also includes two opposed strength supports formed by an upper flap portion and a lower flap portion, each folded and secured to the rear surface of the target backer. The support posts are inserted and functionally retained in the sleeves to support the target backer.

11 Claims, 1 Drawing Sheet

PORTABLE TARGET STAND

BACKGROUND OF THE INVENTION

The present invention relates to a portable target stand for use with firearms which is lightweight, adjustable, and can be set up quickly and easily.

Targets generally provide target images such as bull's-eyes or silhouettes of humans or animals for firearm owners to test and improve their marksmanship. Portable target stands provide a firearm owner with targets where a fixed target holder is not readily available. To be conveniently portable, the target stand must be lightweight and easy to assemble. It is also desirable to be able to adjust the height of the target stand for different target images or for different users. For example, an animal silhouette would preferably be mounted low to the ground, while a silhouette of a human upper torso would preferably be mounted a few feet above the ground. In addition, different users may have different preferences for the mounted height of the target images.

A known portable target stand provides a target frame for holding the target. The target frame is supported by a post mounted on a base having four legs. A wide base is required in order to provide adequate support to the frame and to prevent the stand from being blown over in the wind. The frame and large base make this target stand too heavy and cumbersome to be conveniently portable. Further, the height of the portable target stand is not adjustable for different target images or different users.

Another known portable target stand provides one or more rods inserted into the ground and fixed to two or more horizontal rods. The target is then secured to the horizontal rods with a plurality of clips. However, the horizontal rods increase the total weight of the stand and number of parts, making it less portable. The use of the numerous clips increases the number of parts in the time required to set up the target stand. Additionally, the height of the portable target stand cannot be changed for different target images or adjusted to accommodate the preferences of users.

SUMMARY OF THE INVENTION

The present invention provides a portable target stand which is lightweight, adjustable, and can be set up quickly and easily. The portable target stand of the present invention is a lightweight, one-piece target backer adjustably mounted on a pair of vestal support posts inserted into the ground. An alternate embodiment provides a portable target stand in which each vertical support post comprises a pair of adjustable telescoping tubes.

The target backer includes a target mounting portion having a front surface for mounting targets having one or more target images such as bull's-eyes or silhouettes. Formed into the rear surface of the target backer is a pair of sleeves into which vertical support posts, which can be pushed or hammered into the ground, are inserted. Further, in the preferred embodiment, the rear surface of the target portion includes strengthening supports. These are preferably positioned along the target top and bottom edges and extend generally perpendicular to the sleeves. In the disclosed embodiment, the supports are made by folding the edge of the target back over.

Target means can be mounted at a greater distance above the ground with a target stand according to an alternate embodiment of the present invention. The alternate embodiment includes vertical support posts which comprise telescoping upper and lower tubular posts. The lower tubular posts are partially inserted into the ground. Upper tubular posts are inserted into the sleeves of the target backer and into the lower tubular posts. Preferably, each upper and lower tubular post includes a series of pairs of aligned apertures through which a pin can be selectively inserted. The height of each upper tubular post is adjusted by inserting the pin through a selected pair of apertures in the lower tubular post. By inserting the pins into different apertures in the upper and lower posts, the height of the target stand can be adjusted for different users or for different target images. For example, a human silhouette could be mounted at approximately the height of an average person.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
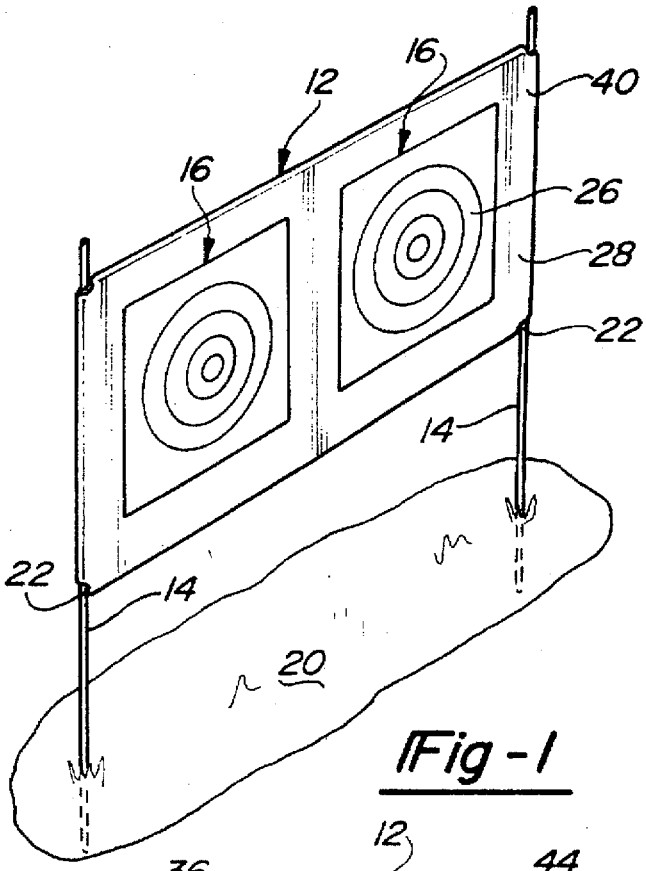
FIG. 1 is a front elevation view of the portable target stand in accordance with the first embodiment of the present invention.

FIG. 1 shows a portable target stand 10 in accordance with the present invention. The portable target stand 10 generally comprises a target backer 12, two vertical support posts 14, and target means 16.

Each vertical support post 14 is preferably between ¼ inch and 5/16 inch in diameter and at least six inches taller than the target backer. The vertical support posts 14 can be made of wood, metal, plastic or other suitable material and can have a pointed end 18 to facilitate insertion into the ground 20. Preferably, the vertical support posts 14 are hollow or tubular to reduce their weight.

Targets 16 comprising paper, cardboard, foam, or other suitable material, is mounted on the target backer 12 to display one or more target images 26, such as a bull's-eye or a human or animal silhouette.

Figure 2:
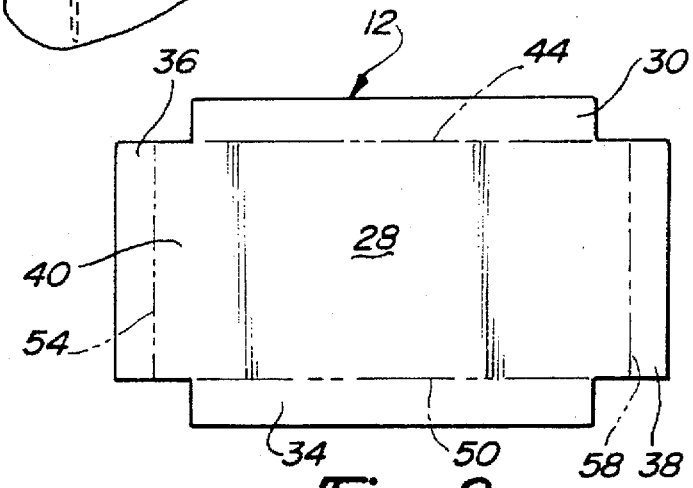
FIG. 2 is a front elevation view of the unfolded target backer of FIG. 1.
Figure 3:
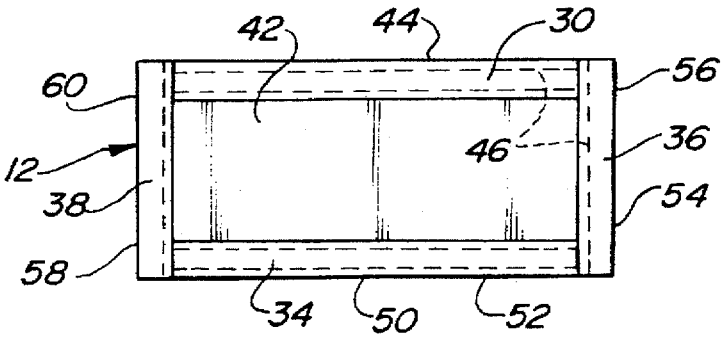
FIG. 3 is an rear elevation view of the folded target backer of FIG. 2.

As can be seen in the FIGS. 2 and 3, the target backer 12 is generally planar and is preferably a single sheet of corrugated cardboard or other suitable lightweight, rigid material. The target backer 12 has a target portion 28, an upper flap portion 30, a lower flap portion 34, a left flap portion 36, and a right flap portion 38. The target portion 28 is generally rectangular and has a front surface 40 and a rear surface 42.

The upper flap portion 30 extends substantially across the upper edge 44 of the target portion 28 and projects from the upper edge 44 of the target portion 28. The upper flap portion 30 is folded and secured to the rear surface 42 of the target portion 28 by adhesive or staples 46 or other suitable means to form an upper support 48. The lower flap portion 34 projecting from the lower edge 50 of the target portion 28 extends across substantially the entire lower edge 50 of the target portion 28. The lower flap portion 50 is folded and secured to the rear surface 42 of the target portion 28 to provide a lower support 52. The left flap portion 36 projects from the left edge 54 of the target portion 28 and extends across the left edge 54 of the target portion 28. The left flap portion 36 is folded and secured to the rear surface 42 of the target portion 28 only along the left edge of the left flap portion 36 by staples 46 or adhesive or other suitable means, thereby forming a left vertical support sleeve 56. The right flap portion 38 projects from the right edge 58 of the target portion 28 and extends across the right edge 58 of the target portion 28. The right flap portion 38 is folded and secured to the rear surface 42 of the target portion 28 only along the right edge of the right flap portion 38, thereby forming a right vertical support sleeve 60.

During assembly, the vertical support posts 14 are inserted into the vertical support sleeves 60 and then pushed or hammered approximately six inches into the ground 20. The sleeves 60 each have an opening that tightly receives the posts 14. Due to the frictional engagement between the posts 14 and sleeves 60, the target backer 12 is supported on posts 14. Targets 16 are then mounted onto the front surface 40 of the target portion 28 of the target backer 12 to display one or more target images 26. As an alternative, the target could be printed on the cardboard target backer, but it is preferable to attach the target to the backer so that the backer can be used more than once.

Figure 4:
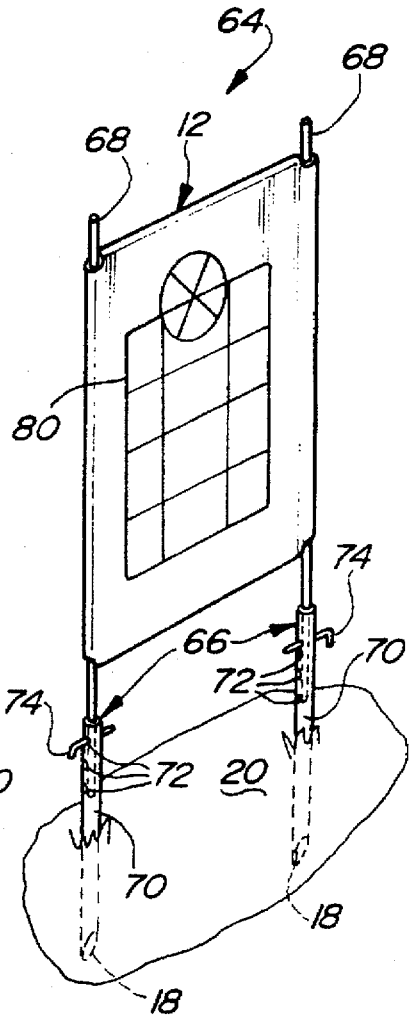
FIG. 4 is a front elevation view of an alternate embodiment of the target stand shown in FIG. 1.

In an alternate embodiment of the portable target stand 64, shown in the FIG. 4, each vertical support post 66 includes an upper tubular post 68 telescopically disposed within a lower tubular post 70. Preferably, each lower tubular post 70 includes a series of axially spaced pairs of aligned apertures 72 through which a pin 74 can be selectively inserted. The preferred lower tubular post 70 comprises a metal or plastic pipe having an approximately ½ inch inner diameter. The upper tubular posts 68 have approximately a 5/16 inch outer diameter.

During setup, the lower tubular posts 70 are pushed or hammered approximately six inches into the ground 20. The upper tubular posts 68 are inserted into the lower tubular posts 70 and supported by the pins 74 inserted through apertures 72 in the lower posts 70. As will be appreciated by those of ordinary skill in the art, the posts 68 could have mating apertures for receipt of pins 74 to obtain a more secure connection. By selectively inserting the pins 74 through a pair of apertures 72 in each lower tubular post 70, the user can adjust the height of the upper tubular posts 68. The upper tubular posts 68 are inserted into the sleeves 56, 60 of the target backer 12. For example, a user might wish to mount target means 16 having a target image 80 of a human silhouette similar to the one shown in the FIG. 4 at a height comparable to that of an average person.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A portable target stand comprising:

a generally planar rigid target backer having:

a generally rectangular target portion with a front surface and a rear surface;

a pair of vertical sleeves formed on the rear surface of said target portion;

vertical posts partially disposed in the vertical sleeves of the target backer, said sleeves and posts frictionally engaging to support said target backer on said posts; and said posts being adapted to be driven into the ground for supporting said target backer above the ground.

2. The portable target stand of claim 1 wherein said target backer further includes at least one strengthening support formed on the rear surface of said target portion.

3. The portable target stand of claim 1 wherein said target backer further comprises:

an upper flap portion extending substantially across the upper edge of said target portion and projecting from the upper edge of the target portion, said upper flap portion being folded and secured to the rear surface of said target portion;

a lower flap portion extending substantially across the lower edge of said target portion and projecting from the lower edge of the target portion, said lower flap portion being folded and secured to the rear surface of said target portion;

a right flap portion extending across the right edge of said target portion and projecting from the right edge of the target portion, said right flap portion being folded and secured to the rear surface of said target portion along the right edge of said right flap portion; and a left flap portion extending across the left edge of said target portion and projecting from the left edge of the target portion, said left flap portion being folded and secured to the rear surface of said target portion along the left edge of said left flap portion.

4. The portable target stand of claim 1 wherein said vertical posts may be tubular.

5. The portable target stand of claim 4 wherein each said vertical post further includes a series of pairs of aligned apertures and a pin selectively insertable through a pair of said aligned apertures.

6. The portable target stand of claim 1 wherein each said vertical post includes an upper tubular post telescopically disposed within a lower tubular post.

7. The portable target stand of claim 6 wherein each said upper and lower tubular posts further include a series of pairs of aligned apertures and a pin selectively insertable through a pair of aligned apertures.

8. A portable target stand for marksmanship comprising:

a generally planar target backer having a generally rectangular target portion, said target backer formed of a rigid material;

said target backer having a right flap portion extending across the right edge of said target portion and projecting from the right edge of the target portion, said right flap portion being folded and secured to said target portion along the right edge of said right flap portion to form a right vertical sleeve;

said target backer having a left flap portion extending across the left edge of said target portion and projecting from the left edge of the target portion, said left flap portion being folded and secured to said target portion along the left edge of said left flap portion to form a left vertical sleeve; and vertical posts partially disposed in said vertical sleeves of said target backer, said sleeves and posts frictionally engaging to support said target backer on said posts, said posts being adapted to be driven into the ground.

9. The portable target stand of claim 8 wherein said target backer further comprises an upper flap portion extending substantially across the upper edge of said target portion and projecting from the upper edge of the target portion, said upper flap portion being folded and secured to said target portion.

10. The portable target stand of claim 8 further including at least one target mounted on said target portion of said target backer.

11. A portable target stand for marksmanship comprising:

a generally planar target backer having a generally rectangular target portion, said target backer formed of a rigid material;

said target backer having a right flap portion extending across the right edge of said target portion and projecting from the right edge of the target portion, said right flap portion being folded and secured to said target portion along the right edge of said right flap portion to form a right vertical sleeve;

said target backer having a left flap portion extending across the left edge of said target portion and projecting from the left edge of the target portion, said left flap portion being folded and secured to said target portion along the left edge of said left flap portion to form a left vertical sleeve;

said target backer having an upper flap portion extending substantially across the upper edge of said target portion and projecting from the upper edge of the target portion, said upper flap portion being folded and secured to said target portion; and vertical posts partially disposed in said vertical sleeves of said larger backer to support said target backer on said posts, said posts being adapted to be driven into the ground.

* * * * *